US009431797B2

(12) United States Patent
Desalvo

(10) Patent No.: US 9,431,797 B2
(45) Date of Patent: Aug. 30, 2016

(54) SPARK PLUG ELECTRODE GAP SETTING TOOL

(71) Applicant: General Electric Company, Schenectady, NY (US)

(72) Inventor: Peter John Desalvo, Jacksonville, FL (US)

(73) Assignee: GENERAL ELECTRIC COMPANY, Schenectady, NY (US)

( * ) Notice: Subject to any disclaimer, the term of this patent is extended or adjusted under 35 U.S.C. 154(b) by 58 days.

(21) Appl. No.: 14/509,727

(22) Filed: Oct. 8, 2014

(65) Prior Publication Data

US 2016/0105002 A1 Apr. 14, 2016

(51) Int. Cl.

| | |
|---|---|
| ***B21D 5/02*** | (2006.01) |
| ***H01T 21/06*** | (2006.01) |
| ***B25B 7/04*** | (2006.01) |
| ***B25B 7/08*** | (2006.01) |
| ***B25B 27/00*** | (2006.01) |

(52) U.S. Cl.

CPC ..... *H01T 21/06* (2013.01); *B21D 5/02* (2013.01); *B25B 7/04* (2013.01); *B25B 7/08* (2013.01); *B25B 27/0035* (2013.01)

(58) Field of Classification Search

CPC ..... B25B 7/00; B25B 7/02; B25B 27/304; B21D 5/02

USPC ..... 72/409.08

See application file for complete search history.

(56) References Cited

U.S. PATENT DOCUMENTS

| | | | | |
|---|---|---|---|---|
| 1,608,176 | A | 11/1926 | Hobbs | |
| 1,629,000 | A * | 5/1927 | Rumely | B25B 7/02 72/409.01 |
| 2,553,620 | A | 5/1951 | Olds | |
| 2,581,439 | A * | 1/1952 | Pentland | H01T 13/24 72/308 |
| 2,645,142 | A * | 7/1953 | Schwenzfeier | B25B 7/00 7/100 |
| 2,670,643 | A * | 3/1954 | Clark | B25B 7/02 7/100 |
| 2,871,741 | A * | 2/1959 | Weisbecker et al. | B21D 5/02 7/100 |
| 3,716,878 | A * | 2/1973 | Gross | B25B 27/304 29/227 |
| 8,485,857 | B1 | 7/2013 | Desalvo | |
| 2013/0187530 | A1 | 7/2013 | Desalvo | |

FOREIGN PATENT DOCUMENTS

| | | |
|---|---|---|
| FR | 515205 A | 3/1921 |
| WO | 2014055081 A1 | 4/2014 |

OTHER PUBLICATIONS

EP Search Report; EP3006163; Mar. 13, 2016, 2 pages.

* cited by examiner

*Primary Examiner* — David B Jones
(74) *Attorney, Agent, or Firm* — Fletcher Yoder, P.C.

(57) ABSTRACT

A spark plug electrode gap setting pliers is provided. The pliers include a first jaw portion coupled to a first shim and a second jaw portion coupled to a second shim. Upon actuation of the pliers, the first and second jaw portions close in parallel to bend respective electrode supports of a pair of electrodes or to bend the pair of electrodes to provide a parallel gap between the pair of electrodes.

17 Claims, 5 Drawing Sheets

SPARK PLUG ELECTRODE GAP SETTING TOOL

BACKGROUND

The subject matter disclosed herein relates to a tool for setting a spark plug electrode gap.

Many reciprocating engines (e.g., internal combustion engines, such as spark ignition liquid, or gas fuel engines) utilize a spark plug to ignite combustion of a fuel with an oxidant within a combustion chamber. Typically, it is desirable to maintain a specific electrode gap between electrodes of the spark plug to ensure proper engine operation. Improper adjustment or setting of the electrode gap may result in a shorter life for the spark plug (e.g., due to unequal erosion of the electrodes) and/or poorer ignition within the engine.

BRIEF DESCRIPTION

Certain embodiments commensurate in scope with the originally claimed invention are summarized below. These embodiments are not intended to limit the scope of the claimed invention, but rather these embodiments are intended only to provide a brief summary of possible forms of the invention. Indeed, the invention may encompass a variety of forms that may be similar to or different from the embodiments set forth below.

In accordance with a first embodiment, a spark plug electrode gap setting pliers is provided. The pliers include a first jaw portion coupled to a first shim and a second jaw portion coupled to a second shim. Upon actuation of the pliers, the first and second jaw portions close in parallel to bend respective electrode supports of a pair of electrodes or to bend the pair of electrodes to provide a parallel gap between the pair of electrodes.

In accordance with a second embodiment, a system includes a tool configured to set a spark plug electrode gap between a pair of electrodes of a spark plug. The tool includes a first jaw portion including a first portion and a second portion, wherein the first portion has a first longitudinal length and the second portion has a second longitudinal length less than the first longitudinal length. The tool also includes a second jaw portion including a third portion and a fourth portion disposed across from the first and second portions of the first jaw portion respectively, wherein the third portion has a third longitudinal length and the fourth portion has a fourth longitudinal length less than the third longitudinal length. The tool further includes a first handle portion coupled to the first portion of the first jaw portion. The tool still further includes a second handle portion coupled to the third portion of the second jaw portion, wherein the first and second handle portions are coupled at a fulcrum, and the first and second portions close in parallel with respect to each other along the first, second, third, and fourth longitudinal lengths upon actuation of the first and second handle portions. The system also includes a first shim contacting the first jaw portion and a second shim contacting the second jaw portion. The second longitudinal length of the second portion of the first jaw portion and the fourth longitudinal length of the fourth portion of the second jaw portion, upon actuation of the first and second handle portions, provide a bending moment to the first and second shims, respectively, to bend respective electrode supports of the pair of electrodes or bend the pair of electrodes to provide a parallel gap between the pair of electrodes.

In accordance with a third embodiment, spark plug electrode gap setting pliers are provided. The pliers include a first jaw portion coupled to a first shim and a second jaw portion coupled to a second shim. Upon actuation of the pliers, the first and second jaw portions close to bend respective electrode supports of a pair of opposing electrodes or to bend the pair of opposing electrodes to set a radial gap distance relative to a longitudinal length of a spark plug between the pair of opposing electrodes. The first and second jaw portions are configured to interchangeably couple to shims of different thicknesses to provide different radial gap distances between the pair of opposing electrodes upon actuation of the pliers.

BRIEF DESCRIPTION OF THE DRAWINGS

These and other features, aspects, and advantages of the present invention will become better understood when the following detailed description is read with reference to the accompanying drawings in which like characters represent like parts throughout the drawings, wherein.

DETAILED DESCRIPTION

One or more specific embodiments of the present invention will be described below. In an effort to provide a concise description of these embodiments, all features of an actual implementation may not be described in the specification. It should be appreciated that in the development of any such actual implementation, as in any engineering project, numerous implementation-specific decisions must be made to achieve the developers' specific goals, such as compliance with system-related and business-related constraints, which may vary from one implementation to another. Moreover, it should be appreciated that such a development effort might be complex and time consuming, but would nevertheless be a routine undertaking of fabrication and manufacture for those of ordinary skill having the benefit of this disclosure.

When introducing elements of various embodiments of the present invention, the articles "a," "an," "the," and "said" are intended to mean that there are one or more of the elements. The terms "comprising," "including," and "having" are intended to be inclusive and mean that there may be additional elements other than the listed elements.

The present disclosure is directed to a tool (e.g., pliers) for setting a spark plug electrode gap. In particular, embodiments of the present disclosure include pliers (e.g., spark plug electrode gap setting pliers) that include jaw portions coupled to shims, where upon actuation of the pliers (e.g., actuation of handle portions of the pliers) the jaw portions close in parallel to bend respective electrode supports of a pair of electrodes (e.g., opposing electrodes) or to bend the pair of electrodes to provide a parallel gap between the pair of electrodes. In certain embodiments, jaw portions may each be configured to interchangeably couple to shims of different sizes to provide different parallel gap distances between the pair of electrodes upon actuation of the pliers. For example, the pliers may include fasteners to secure the shims to the respective jaw portions. These fasteners may be adjusted to enable removal or securing of the shims to the jaw portions. In certain embodiments, the jaw portions may each include a couple of portions with one of the portions having a shorter longitudinal length than the other portion. The longitudinal lengths of the shorter jaw portions may provide a bending moment to the shims to enable the bending of the electrode supports or electrodes. The disclosed embodiments of the pliers may enable a more accurate and a more parallel gap to be set between the electrodes. In addition, by setting a more accurate and more parallel gap, erosion may occur more evenly on the electrodes and extend the life of the spark plug.

Figure 1:
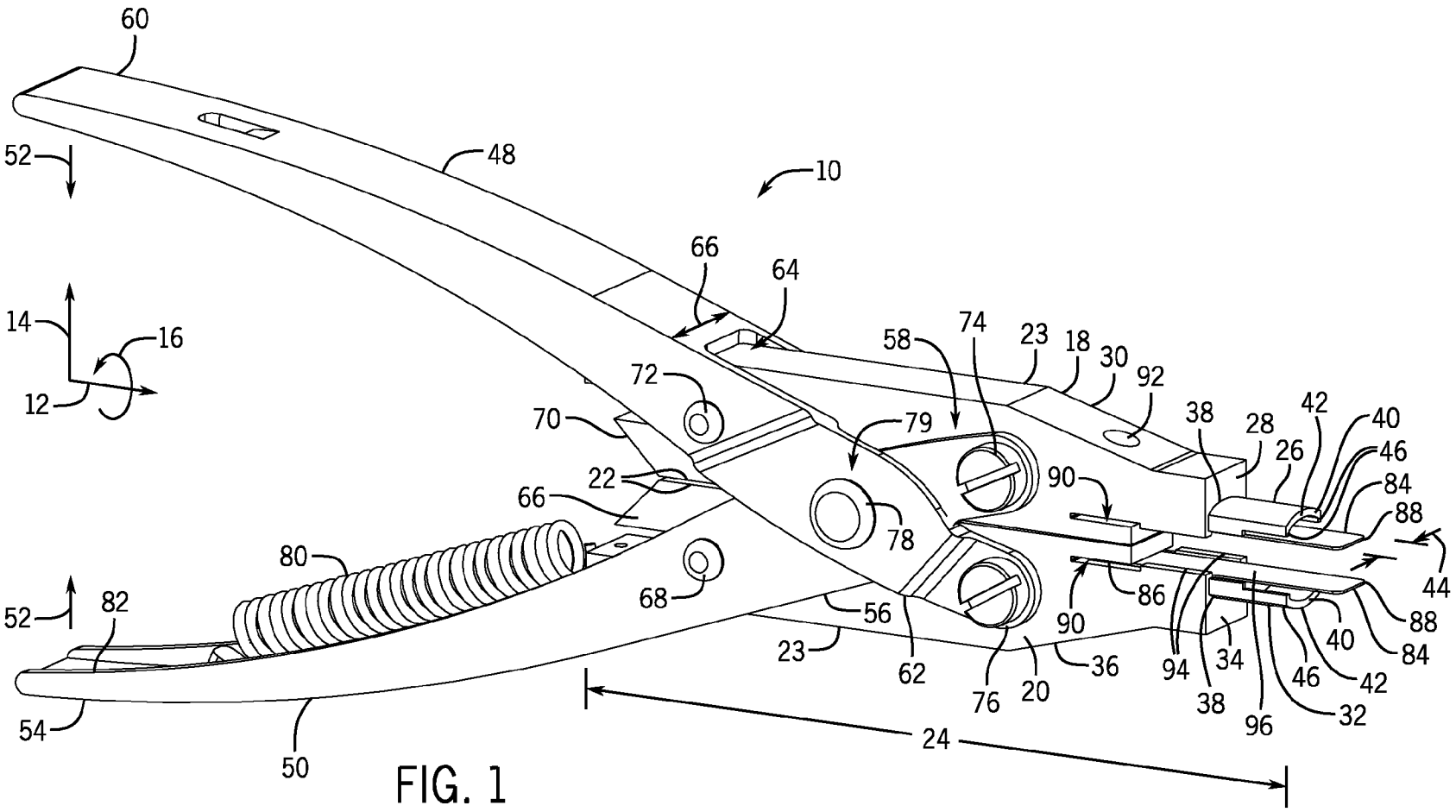
FIG. 1 is a perspective view of an embodiment of a tool (e.g., pliers) for setting a spark plug electrode gap.

Turning now to the drawings and referring first to FIG. 1, a perspective view of an embodiment of tool or pliers 10 (e.g., spark plug electrode gap setting pliers) for setting a spark plug electrode gap is illustrated. In the following discussion, reference may be made to a longitudinal axis or axial direction 12, a radial axis or direction 14, and/or a circumferential axis or direction 16 of the pliers 10. As described in detail below, the disclosed pliers 10 enable a more accurate and more parallel gap (i.e., spark plug gap) to be set between opposing electrodes of a spark plug. By setting a more accurate and more parallel gap, erosion may occur more evenly on the electrodes and extend the life of the spark plug. The disclosed pliers 10 may be utilized on any pair of opposing electrodes of a spark plug having a gap (e.g., radial gap relative to a longitudinal axis of the spark plug). The pliers 10 may also be utilized on a single electrode gap or multiple electrode gaps simultaneously.

As depicted in FIG. 1, the pliers 10 include jaw portions 18, 20 that are structurally mirror images of each other. Each jaw portion 18, 20 includes an inward facing surface 22 (i.e., facing towards the other jaw portion 18, 20) and outward facing surface 23. The inward facing surfaces 22 of the jaw portions 18, 20 interface with each other along a longitudinal length 24 of the jaw portions 18, 20. Jaw portion 18 includes portion 26 that axially 12 extends from an axial end 28 of portion 30. Jaw portion 20 includes portion 32 that axially 12 extends from an axial end 34 of portion 36. Portions 26, 30 are disposed across from portions 20, 32, respectively. Portions 26, 30 of jaw portion 18 differ in longitudinal length (see FIG. 3). Portions 32, 36 of jaw portion 20 also differ in longitudinal length (see FIG. 3). For example, the longitudinal lengths of portions 26, 32 are less than the longitudinal lengths of portions 30, 36. The portions 26, 32 include a maximum height (e.g., in the radial direction 14) that is less than a minimum height (e.g., in the radial direction 14) of the jaw portions 18, 20 (see FIG. 3). In certain embodiments, the height of the portions 30, 36 gradually decreases along their longitudinal lengths towards respective axial ends 28, 34 (see FIG. 3). In certain embodiments, the height of the portions 26, 32 also decrease along their longitudinal lengths from end portions 38 coupled to respective axial ends 28, 34 to end portions 40 (e.g., free end portions). In some embodiments, the height of the portions 26, 32 may be constant along their longitudinal lengths. As depicted, the portions 26, 32 include a wall portion 42 (e.g., arcuate-shaped wall portion) that extends both in the axial direction 12 and in a direction 44 perpendicular to the longitudinal axis 12 of the pliers 10. In certain embodiments, each wall portion 42 may be flat. As depicted, each wall portion 42 is flanked by wall portions 46 (e.g., parallel side wall portions) that extend radially 14 from the wall portion 42. In certain embodiments, no wall portions 46 may extend from the wall portion 42.

The pliers 10 also include handle portions 48, 50 coupled to the jaw portions 18, 20. Actuation (e.g., squeezing) of the handle portions 48, 50 towards each other (as indicated by reference numeral 52) enables the jaw portions 18, 20 to close in parallel with respect to each other along their longitudinal lengths 24. The handle portion 50 includes end portions 54, 56. A recess 58 is located within the handle portion 50 adjacent end portion 56 that enables the end portion 56 to be disposed about (e.g., flank) portions of the jaw portions 18, 20. The handle portion 48 includes end portions 60, 62. A recess 64 is located within the handle portion 48 adjacent end portion 62 that enables the end portion 62 to be disposed about (e.g., flank) the end portion 56 of the handle portion 50 and portions of the jaw portions 18, 20. Thus, the recess 64 increases in width 66 adjacent where the end portion 62 of the handle portion 48 flanks the end portion 56 of the handle portion 50. The handle portion 50 is coupled to the jaw portion 20 adjacent an axial end 66 of the jaw portion 20 (e.g., opposite the axial end 34) via a fastener 68 (e.g., pin, rivet, etc.) that extends through the jaw portion 20 and forms a rotational joint. The handle portion 48 is coupled to the jaw portion 18 adjacent an axial end 70 of the jaw portion 18 (e.g., opposite the axial end 28) via a fastener 72 (e.g., pin, rivet, etc.) that extends through the jaw portion 18 and forms a rotational joint. The handle portion 50 is also coupled to the jaw portion 18 at a location between the axial end 28 and the coupling of the handle portion 48 adjacent the axial end 70 via a fastener 74 (e.g., pin, rivet, screw and nut, etc.) that extends through the jaw portion 18 and forms a rotational joint. The handle portion 48 is also coupled to the jaw portion 20 at a location between the axial end 34 and the coupling of the handle portion 50 adjacent the axial end 66 via a fastener 76 (e.g., pin, rivet, screw and nut, etc.) that extends through the jaw portion 20 and forms a rotational joint. Both of the handle portions 48, 50 are coupled to both of the jaw portions 18, 20 via a common fastener 78 (e.g., pin, rivet, etc.) that passes through both of the jaw portions 18, 20 at a location between where the handle portions 48, 50 are coupled to the jaw portions 18, 20 via the fasteners 68, 72, 74, 76. The common fastener 78 passing through both of the jaws also forms a fulcrum 79 (e.g., rotational joint) where the handle portions 48, 50 are coupled to the jaw portions 18, 20.

As depicted, the handle portion 50 includes a biasing element 80 (e.g., spring) on an inward surface 82 (i.e., facing handle portion 48) that biases (e.g., spring loads) the handle portions 48, 50 into an open position. The biasing element 80 is coupled to the handle portion 50 adjacent the end portion 54 and to the axial end 66 of the jaw portion 20. In certain embodiments, the handle portion 48 may also include an additional biasing element. Alternatively, the handle portion 48 alone may include a biasing element.

As depicted, the pliers 10 further include shims 84. Actuation 52 of the pliers 10 (e.g., handle portions 48, 50) enables the jaw portions 18, 20 to close in parallel to bend respective electrode supports of a pair of electrodes of a spark plug or to bend the pair of electrodes to provide a parallel gap (e.g., gap of equal distance along length of gap) between the pair of electrodes. The longitudinal lengths of the portions 26, 32 of the jaw portions 18, 20 are of a length to provide a bending moment to the first and second shims to bend the respective electrode supports of the pair of electrodes or to bend the pair of electrodes to provide the parallel gap between the pair of electrodes. Each jaw portion 18, 20 is coupled to a single shim 84 adjacent axial ends 28, 34, respectively, of the portions 30, 36. Ends 86 of the shims 84 are coupled to the portions 30, 36, while ends 88 extend axially 12 beyond the end portions 40 of the portions 26, 32 of the jaw portions 18, 20, respectively. The shims 84 may be coupled (e.g., secured) to the jaw portions 18, 20 via fasteners 142 (e.g., screws, Allen screws, snap-fit, latch, thumb screw, friction or interference fit, etc.) (see FIG. 5). In certain embodiments, the shims 84 may not be coupled or secured to the jaw portions 18, 20, but instead only contact the jaw portions 18, 20. The jaw portions 18, 20 each include a recess 90 to receive the end 86 of a respective shim 84. Each jaw portion 18, 20 also includes a bore 92 located adjacent the axial ends 28, 34. Each bore 92 radially 14 extends perpendicular (e.g., crosswise) to the longitudinal length 24 or axis 12 of the jaw portions 18, 20 through the portions 30, 36 from surface 23 to surface 22. As described in greater detail below, the fasteners 142 are disposed within the bores 92 to secure the shims 84 to the jaw portions 18, 20 (see FIG. 5). In addition, the fasteners 142 may be adjusted to enable the removal of the shims 84 and replacement with different shims (e.g., of a different size). Thus, the fasteners 142 enable the jaw portions 18, 20 to interchangeably couple to shims of different thicknesses to provide different parallel gap distances between the pair of electrodes upon actuation of the pliers 10. For example, a first pair of shims, each of the same size, may provide a first gap distance, while a second pair of shims, each of the same size (but of a different size from the first pair of shims) may provide a second gap distance different from the first gap distance. The pliers 10 may be coupled to any number of shim sets, e.g., 2, 3, 4, 5, 6, 7, 8, 9, 10, or more shim sets, which are different from one another to provide different gap distances. Wall portions 94 at the axial ends 28, 34 of the portions 30, 36 may extend in the radial direction 14 to be nearly flush with or extend beyond an inward facing surface 96 (i.e., surface facing other shim 84 and that contacts an electrode or electrode support) of a respective shim 84 to block movement of the shim 84 in the direction 44.

Figure 2:
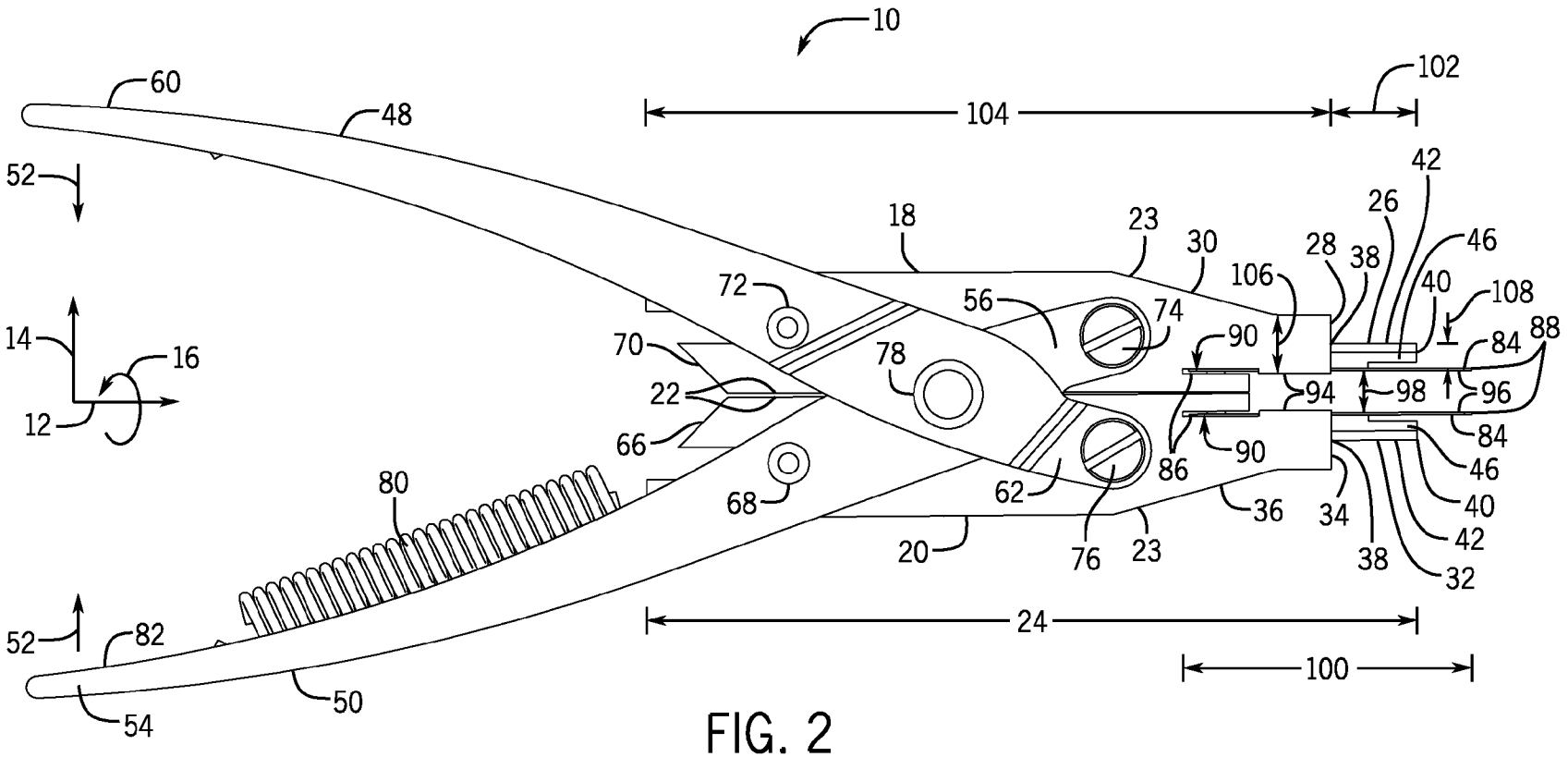
FIG. 2 is a side axial view of the pliers in FIG. 1.

FIG. 2 is a side axial view of the pliers 10 in FIG. 1. The pliers 10 are structurally and functionally as described in FIG. 1. Actuation 52 of the pliers 10 (e.g., handle portions 48, 50) enables the jaw portions 18, 20 to close in parallel (e.g., along the longitudinal lengths 24 of the jaw portions 18, 20) to bend respective electrode supports of a pair of electrodes of a spark plug or to bend the pair of electrodes to provide a parallel gap (e.g., gap of equal distance along length of gap) between the pair of electrodes. The closing of the jaw portions 18, 20 in parallel also results in the shims 84 closing in parallel. Thus, a distance or gap 98 between the surfaces 96 of the shims 84 along their longitudinal length 100 in the axial direction 12 is constant.

A longitudinal length 102 of portions 26, 32 of the respective jaw portions 18, 20 is of a length to provide a bending moment to the first and second shims to bend the respective electrode supports of the pair of electrodes or to bend the pair of electrodes to provide the parallel gap between the pair of electrodes. The longitudinal length 102 of the portions 26, 32 is less than a longitudinal length 104 of each portion 30, 36, of the respective jaw portions 18, 20. The longitudinal length 102 may be less than approximately 50 percent and greater than 0 percent of the longitudinal length 24 of the jaw portions 18, 20. The longitudinal length 102 may range between approximately greater than 0 to 25 percent, greater than 0 to 15 percent, 15 to 25 percent, 25 to less than 50 percent, 35 to less than 50 percent, and all subranges therein of the longitudinal length 24 of the jaw portions 18, 20. For example, the longitudinal length 102 may be approximately 5, 10, 15, 20, 25, 30, 35, 40, or 45 percent of the longitudinal length 24. A ratio of the longitudinal length 104 of the portions 30, 36 to the longitudinal length 102 of the portions 26, 32 may range from approximately 10:1 to 1.25:1, 10:1 to 5:1, 1.25:1 to 5:1, and all subranges therein. The ratio of the longitudinal length 104 of the portions 30, 36 to the longitudinal length 102 of the portions 26, 32 may be approximately 10:1, 9:1, 8:1, 7:1, 6:1, 5:1, 4:1, 3:1, 2:1, 1.5:1, 1.25:1, and all ratios therebetween.

Also, as mentioned above, a height 106 (e.g., from surface 23 to surface 22 in radial direction 14) of the portions 30, 36 of the jaw portions 18, 20 may vary along the longitudinal length 104. For example, the height 106 may gradually decrease (e.g., in a linear or non-liner manner) from the axial ends 66, 70 to the axial ends 28, 34 (e.g., with the smallest height 106 being located adjacent axial ends 28, 34). At certain portions along the longitudinal length 104, the height 106 may be constant. Also, a height 108 (e.g., from surface 23 to surface 22 in radial direction 14) of the portions 26, 32 may vary along the longitudinal length 102. For example, the height 108 may gradually decrease (e.g., in a linear or non-liner manner) from the axial ends 38 to the axial ends 40 (e.g., with the smallest height 108 being located adjacent axial ends 40). At certain portions along the longitudinal length 102, the height 108 may be constant. In certain embodiments, the height 108 may decrease in a stepped manner from the axial ends 38 to the axial ends 40. The maximum height 108 of the portions 26, 32 is less than the minimal height 106 of the portions 30, 36 of the jaw portions 18, 20. The height 108 may be range from approximately greater than 0 to 90 percent, 10 to 50 percent, 10 to 25 percent, 25 to 50 percent, 50 to 90 percent, 50 to 75 percent, 75 to 90 percent, and all subranges therein, of the height 106. For example, the height 108 may be 10, 20, 30, 40, 50, 60, 70, 80, or 90 percent of the height 106. A ratio of the height 106 to the height 108 may range from approximately 10:1 to 1.25:1, 10:1 to 5:1, 1.25:1 to 5:1, and all subranges therein. In certain embodiments, the ratio of the height 106 to the height 108 may be approximately 10:1, 9:1, 8:1, 7:1, 6:1, 5:1, 4:1, 3:1, 2:1, 1.5:1, 1.25, and all ratios therebetween.

Figure 3:
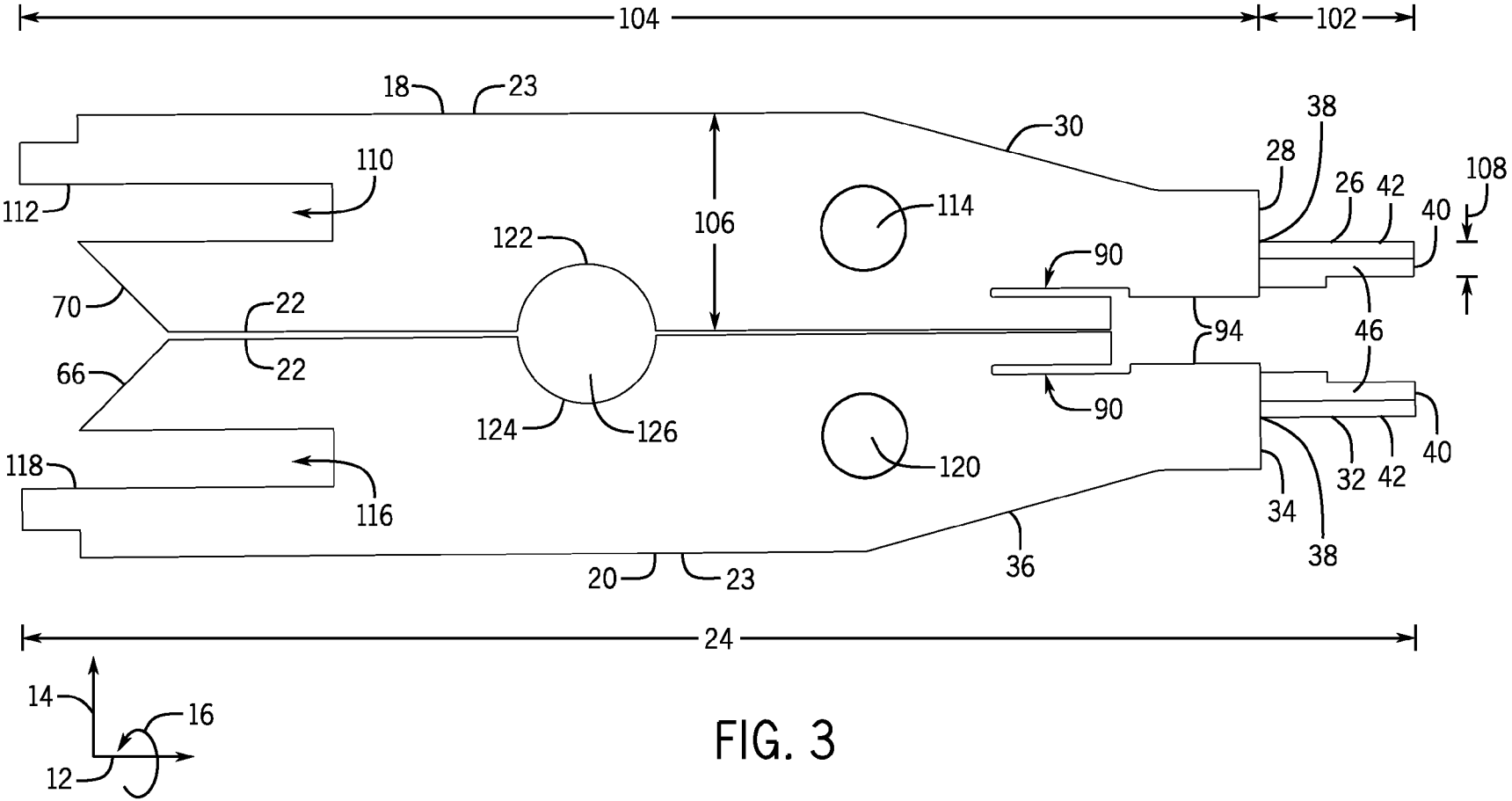
FIG. 3 is a side axial view of an embodiment of jaw portions of the pliers in FIG. 1.

FIG. 3 is a side axial view of an embodiment of the jaw portions 18, 20 of the pliers 10 in FIG. 1. The jaw portions 18, 20 are as described in FIGS. 1 and 2. As depicted in FIG. 3, the jaw portions 18, 20 include recesses and/or openings for the fasteners described above. For example, the axial end 70 of the portion 30 of the jaw portion 18 includes a recess 110 (e.g., elongated recess or slot extending through portion 30 perpendicular to the longitudinal length 104) for receiving the fastener 72 (e.g., rivet or pin). The axial end 70 of the portion 30 also includes an opening 112 (e.g., extending crosswise relative to the longitudinal length 104 between the surfaces 22, 23) that enables coupling of the biasing element 80 to the jaw portion 18. Between the recess 110 and the axial end 28, the portion 30 includes an opening 114 (e.g., cylindrical opening) that extends through portion 30 perpendicular to the longitudinal length 104 for receiving the fastener 74 (e.g., rivet, pin, screw and nut, etc.). In certain embodiments, the opening 114 may be located closer to axial end 28 than axial end 70. The axial end 66 of the portion 36 of the jaw portion 20 includes a recess 116 (e.g., elongated recess or slot extending through portion 36 perpendicular to the longitudinal length 104) for receiving the fastener 68 (e.g., rivet or pin). Recesses 110, 116 axially 12 extend parallel with respect to each other along the longitudinal length 104. The axial end 66 of the portion 36 also includes an opening 118 (e.g., extending crosswise relative to the longitudinal length 104 between the surfaces 22, 23) that enables coupling of the biasing element 80 to the jaw portion 20. Between the recess 116 and the axial end 34, the portion 36 includes an opening 120 (e.g., cylindrical opening) that extends through portion 36 perpendicular to the longitudinal length 104 for receiving the fastener 76 (e.g., rivet, pin, screw and nut, etc.). In certain embodiments, the opening 120 may be located closer to axial end 34 than axial end 66. Portions 30, 36 of jaw portions 18, 20 include cavities or recesses 122, 124, respectively, which together define an opening 126 that extends through portions 30, 36 for receiving the fastener 78 (e.g., rivet, pin, etc.).

Figure 4:
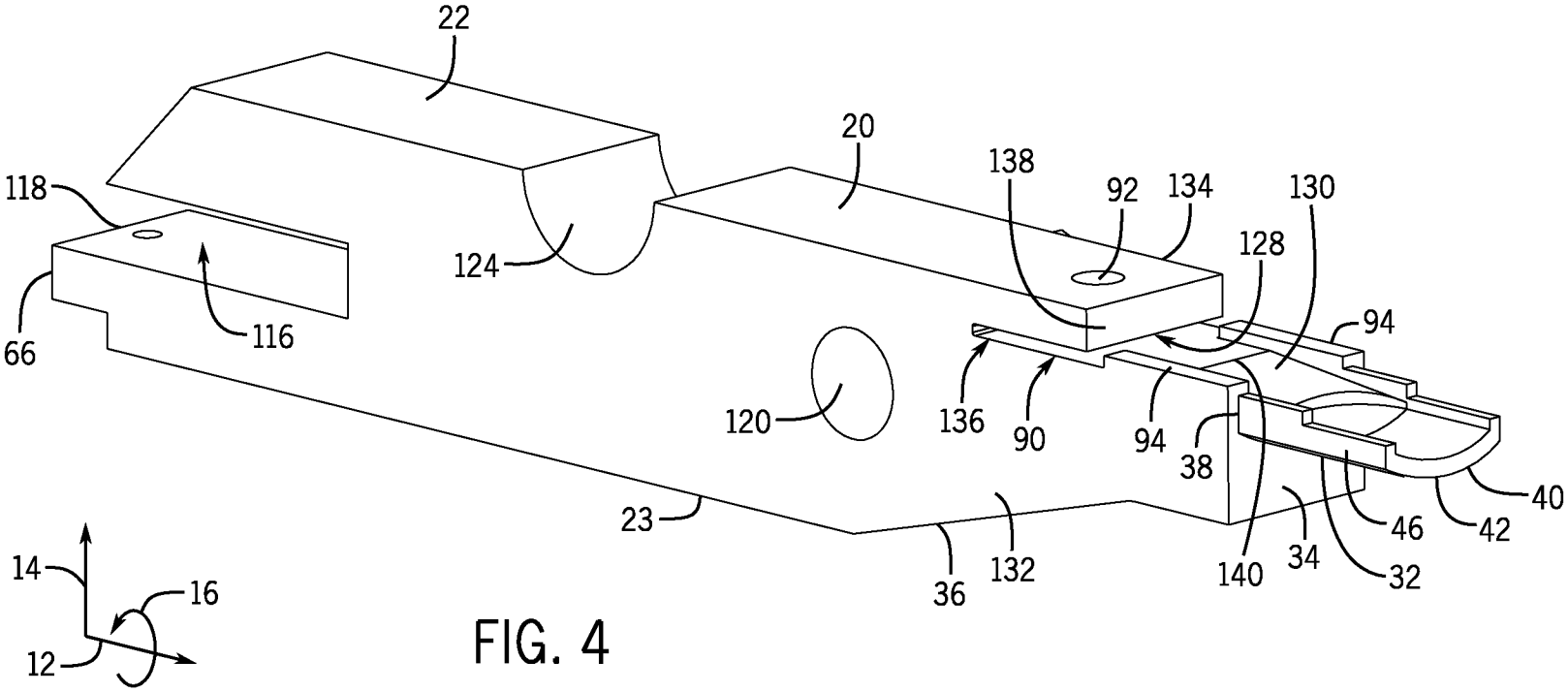
FIG. 4 is a perspective view of a jaw portion of the pliers in FIG. 3.

FIG. 4 is a perspective view of the jaw portion 20 of the pliers 10 in FIG. 3. Jaw portion 18 is structurally and functionally the same as jaw portion 20. Also, jaw portions 18, 20 are structurally and functionally as described above. As noted above, the shim 84 is coupled to the portion 36 of the jaw portion 20 adjacent the axial end 34. Specifically, the end 86 of the shim 84 is secured within the recess 90. The recess 90 includes a first recess portion 128 and a second recess portion 130. The first recess portion 128 is defined by a main body portion 132 and an overhang portion 134 of the portion 36 of the jaw portion 20. The overhang portion 134 extends in the axial direction 12 parallel to the main body portion 132 with a gap 136 (e.g., radial gap) between them. The end 86 of the shim 84 is secured within the recess portion 128 as described in greater detail below (see FIG. 5). For example, a fastener 142 disposed within bore 92 may secure or couple the shim 84 to the jaw portion 20. The bore 92 extends through both the main body portion 132 and the overhang portion 134. The main body portion 132 extends in the axial direction 12 beyond an axial end 138 (e.g., free end) of the overhang portion 134. As described above, the wall portions 94 at the axial end 34 of the portions 36 extends in the radial direction 14 to be nearly flush with or extend beyond the inward facing surface 96 of the shim 84 (see FIG. 1). These wall portions 94 along with surface 140 define the second recess portion 130 of the recess 90.

Figure 5:
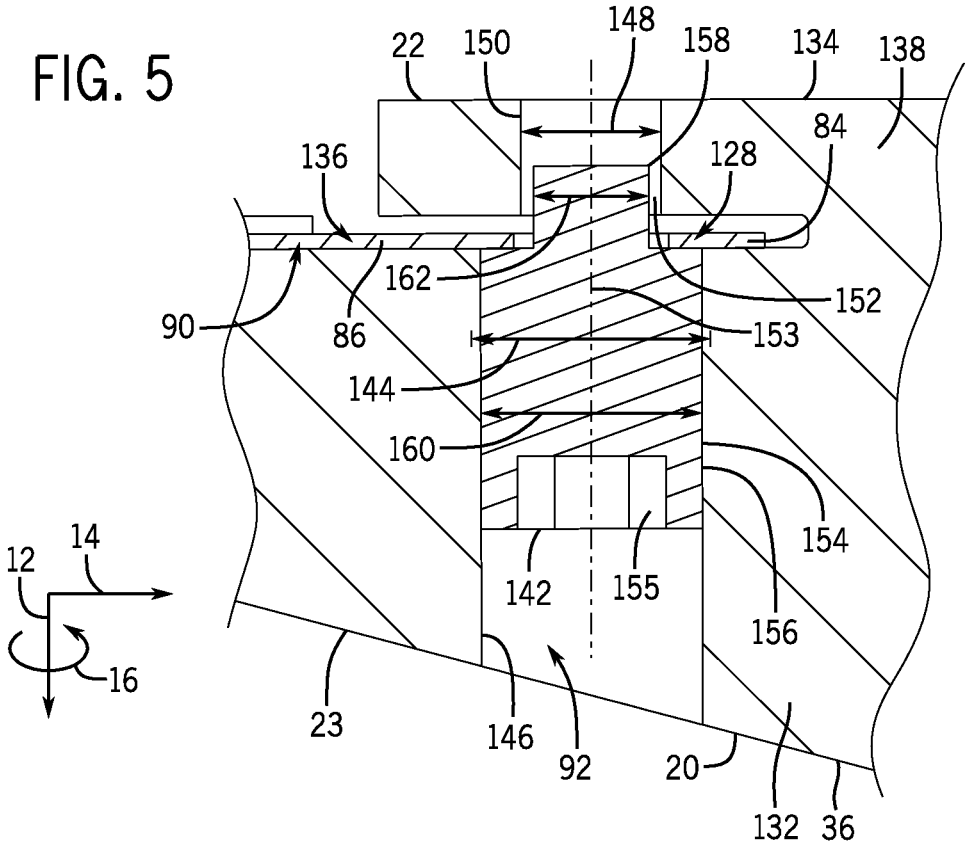
FIG. 5 is a partial cross-sectional side axial view of an embodiment of a fastener securing a shim to the jaw portion.

FIG. 5 is a partial cross-sectional side axial view of an embodiment of a fastener 142 securing or coupling the shim 84 to the jaw portion 20. Jaw portion 18 is structurally and functionally the same as jaw portion 20. Also, jaw portions 18, 20 are structurally and functionally as described above. The jaw portion 20 includes the bore 92 located adjacent the axial end 34 (see FIG. 1). The bore 92 radially 14 extends perpendicular to the longitudinal length 24 or axis 12 of the jaw portion 20 through the main body portion 132 and partially into the overhang portion 134 of the portion 36 from surface 23 to surface 22. The bore 92 includes a first diameter 144 between an inner surface 146 of the main body portion 132 and a second diameter 148 between an inner surface 150 of the overhang portion 134. The first diameter 144 is greater than the second diameter 148. In certain embodiments, the inner surface 146 of the bore 92 in the main body portion 132 may be threaded (e.g., for threading to fastener 142). The end 86 of the shim 84 includes an opening 152 to receive the fastener 142 to secure the shim 84 to the jaw portion 20. When properly disposed within the recess 90, a center of the opening 152 aligns with a central axis 153 through the bore 92.

The fastener 142 may include a threaded fastener or screw (e.g., Allen screw) or any other type of fastener that can have a position changed within the bore 92. In certain embodiments, the fastener 142 may include a recess 155 to receive a tool (e.g., Allen wrench or other type of wrench, etc.) to rotate the fastener 142. In certain embodiments, a surface 154 may include a threaded surface to engage threads of the bore 92. In certain embodiments, the fastener 142 may include an anti-vibrational feature to block loosening of the fastener 142 due to unintentional or vibrational loosening. The fastener 142 includes a main body portion 156 portion and a nose portion 158. The main body portion 156 includes a first diameter 160 and the nose portion 158 includes a second diameter 162. The first diameter 160 is greater than the second diameter 162. As depicted in FIG. 5, when the fastener 142 is in a position to secure or couple the shim 84 to the jaw portion 20, the nose portion 158 extends through the opening 152 of the shim 84 and the bore 92 into the overhang portion 134. The main body portion 156 is disposed within the bore 92 in the main body portion 132 of the portion 36. In certain embodiments, depending on the diameter 162 of the opening 152 in the shim 84, a portion of the main body portion 156 of the fastener 142 may extend into the opening 152. To secure the shim 84 to the jaw portion 20, the fastener 142 is moved linearly along its axis (e.g., in response to rotation) in the radial direction 14 towards the overhang portion 138. To enable removal of the shim 84, the fastener 142 is moved linearly along its axis (e.g., in response to rotation) in the radial direction 14 away from the overhang portion 138 until no portion of the fastener 142 is disposed within the opening 152 of the shim 84. The adjustment of the fastener 142 enables the removal of the shims 84 and replacement with different shims 84 (e.g., of a different size). Thus, the fasteners 142 enable the jaw portions 18, 20 to interchangeably couple to shims of different thicknesses to provide different parallel gap distances between the pair of electrodes upon actuation of the pliers 10. For example, a first pair of shims, each of the same size, may provide a first gap distance, while a second pair of shims, each of the same size (but of a different size from the first pair of shims) may provide a second gap distance different from the first gap distance. In certain embodiments, the shims 84 may not be coupled or secured to the jaw portions 18, 20, but instead merely contact the jaw portions 18, 20.

Figure 6:
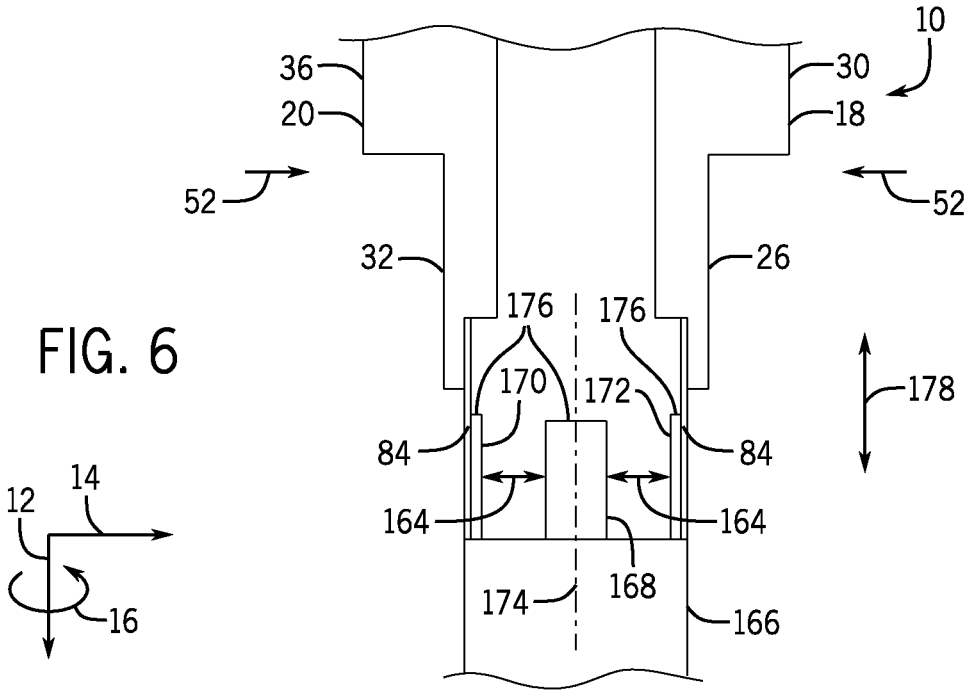
FIG. 6 is a schematic view of an embodiment of the pliers of FIG. 1 setting multiple spark plug electrode gaps.

As mentioned above, the pliers 10 may be utilized on any pair of opposing electrodes of a spark plug having a gap (e.g., radial gap relative to a longitudinal axis of the spark plug). FIG. 6 is a schematic view of an embodiment of the pliers 10 of FIG. 1 setting multiple spark plug electrode gaps 164 of a spark plug 166 simultaneously. In certain embodiments, the pliers 10 may also be utilized on a single electrode gap. Only portions of the pliers 10 and the spark plug 166 are depicted in FIG. 6. The pliers 10 are as described above. As depicted, the spark plug 166 includes structures 168, 170, 172 extending in the axial direction 12 from the spark plug 166. The structures 168, 170, 172 include gaps 164 (e.g., radial gap relative to a longitudinal axis 174 of the spark plug 166) between them. In certain embodiments, structure 168 represents the central electrode 168, while structures 170, 172 represent side electrodes 170, 172 (e.g., ground electrodes). In certain embodiments, structures 168, 170, 172 may refer to the electrode supports and the electrodes may be located at free ends 176 of the supports 168, 170, 172. Actuation 52 of the pliers 10 (e.g., handle portions 48, 50) enables the jaw portions 18, 20 to close in parallel to bend the structures 168 and 172 (e.g., electrode supports and/or electrodes) of the spark plug 166 to provide parallel gaps 164 (e.g., gap of equal distance along a length 178 of gap) between structures 168 and 170 (e.g., electrode supports and/or electrodes) and between structures 168 and 172 (e.g., electrodes and/or electrodes supports. The same process may be carried out with the pliers 10 for a single pair of opposing electrodes 168 and 170 or 168 and 172 to set the gap 164 between them. As mentioned above, the shims 84 are coupled and/or secured to the jaw portions 18, 20. In certain embodiments, the shims 84 are not coupled to the jaw portions 18, 20, but instead contact the jaw portions 18, 20. In this case, the shims 84 are first disposed about the structures 170, 172 and then the pliers 10 are utilized on the shims 84 to provide the parallel gaps 164.

Technical effects of the disclosed embodiments include providing pliers 10 for setting a spark plug electrode gap 164. The pliers 10 may include the jaw portions 18, 20 coupled to the shims 84, where upon actuation of the pliers 10 the jaw portions 18, 20 close in parallel to bend respective electrode supports of a pair of electrodes (e.g., opposing electrodes) or to bend the pair of electrodes to provide a parallel gap between the pair of electrodes. In certain embodiments, the jaw portions 18, 20 may each be configured to interchangeably couple to shims 84 of different sizes to provide different parallel gap distances between the pair of electrodes upon actuation of the pliers 10. The pliers 10 may enable a more accurate and a more parallel gap 164 to be set between the electrodes. In addition, by setting a more accurate and more parallel gap, erosion may occur more evenly on the electrodes and extend the life of the spark plug 166.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims.

The invention claimed is:

1. Spark plug electrode gap setting pliers, comprising:

a first jaw portion coupled to a first shim; and a second jaw portion coupled to a second shim;

wherein, upon actuation of the pliers, the first and second jaw portions close in parallel to bend respective electrode supports of a pair of electrodes or to bend the pair of electrodes to provide a parallel gap between the pair of electrodes, and wherein the first and second jaw portions are each configured to interchangeably couple to shims of different thicknesses to provide different parallel gap distances between the pair of electrodes upon actuation of the pliers.

2. The pliers of claim 1, comprising a first fastener and a second fastener, wherein the first jaw portion has a first bore extending through the first jaw portion in a first direction crosswise to a first longitudinal length of the first jaw portion, the first fastener is disposed within the first bore and extends through the first shim to couple the first shim to the first jaw portion, the second jaw portion has a second bore extending through the second jaw portion in a second direction crosswise to a second longitudinal length of the second jaw portion, and the second fastener is disposed within the second bore and extends through the second shim to couple the second shim to the second jaw portion.

3. The pliers of claim 2, wherein a first surface of the first bore, the first fastener, a second surface of the second bore, and the second fastener are threaded.

4. The pliers of claim 1, wherein the first jaw portion comprises a first recess, a first portion of the first shim is disposed within the first recess, the second jaw portion comprises a second recess, and a second portion of the second shim is disposed within the second recess.

5. The pliers of claim 1, wherein the first jaw portion comprises a first portion and a second portion, the first portion has a first longitudinal length and the second portion has a second longitudinal length less than the first longitudinal length, the second jaw portion comprises a third portion and a fourth portion, and the third portion has a third longitudinal length and the fourth portion has a fourth longitudinal length less than the third longitudinal length.

6. The pliers of claim 1, comprising a first handle portion coupled to the first portion of the first jaw portion, and a second handle portion coupled to the third portion of the second jaw portion.

7. A system, comprising:

a tool configured to set a spark plug electrode gap between a pair of electrodes of a spark plug, wherein the tool comprises:

a first jaw portion comprising a first portion and a second portion, wherein the first portion has a first longitudinal length and the second portion has a second longitudinal length less than the first longitudinal length;

a second jaw portion comprising a third portion and a fourth portion disposed across from the first and second portions of the first jaw portion respectively, wherein the third portion has a third longitudinal length and the fourth portion has a fourth longitudinal length less than the third longitudinal length;

a first handle portion coupled to the first portion of the first jaw portion; and a second handle portion coupled to the third portion of the second jaw portion, wherein the first and second handle portions are coupled at a fulcrum, and the first and second jaw portions are configured to close in parallel with respect to each other along the first, second, third, and fourth longitudinal lengths upon actuation of the first and second handle portions;

a first shim contacting the first jaw portion; and a second shim contacting the second jaw portion;

wherein the second longitudinal length of the second portion of the first jaw portion and the fourth longitudinal length of the fourth portion of the second jaw portion, upon actuation of the first and second handle portions, provide a bending moment to the first and second shims, respectively, to bend respective electrode supports of the pair of electrodes or to bend the pair of electrodes to provide a parallel gap between the pair of electrodes, and wherein the first shim is coupled to the first portion of the first jaw portion, the second shim is coupled to the third portion of the second jaw portion, the first portion of the first jaw portion comprises a first recess, the third portion of the second jaw portion comprises a second recess, a first portion of the first shim is disposed within the first recess, and a second portion of the second shim is disposed within the second recess.

8. The system of claim 7, wherein the second portion of the first jaw portion comprises a first end adjacent the first portion and a second end opposite the first end, the fourth portion of the second jaw portion comprises a third end adjacent the third portion and a fourth end opposite the third end, and the first and second shims extend beyond the second and fourth ends, respectively, in a direction along the second and fourth longitudinal lengths.

9. The system of claim 7, comprising a first fastener and a second fastener, wherein the first fastener extends through the first portion of the first jaw portion, the first recess, and the first shim to couple the first shim to the first portion of the first jaw portion, and second fastener extends through the third portion of the second jaw portion, the second recess, and the second shim to couple the second shim to the third portion of the second jaw portion.

10. The system of claim 7, wherein the first portion of the second jaw portion and the third portion of the second jaw portion are each configured to interchangeably couple to shims of different thicknesses to provide different parallel gap distances between the pair of electrodes upon actuation of the first and second handle portions.

11. The system of claim 7, wherein a first end of the first portion of the first jaw portion adjacent the second portion has a first thickness in a first direction perpendicular to the first longitudinal length, the second portion of the first jaw portion has a second thickness in the first direction that is less than the first thickness, a second end of the third portion of the second jaw portion adjacent the third portion has a third thickness in a second direction perpendicular to the third longitudinal length, the fourth portion of the second jaw portion has a fourth thickness in the second direction that is less than the third thickness.

12. The system of claim 7, wherein the first jaw portion and the first handle portion are separate pieces, and the second jaw portion and the second handle portion are separate pieces.

13. Spark plug electrode gap setting pliers, comprising:

a first jaw portion coupled to a first shim;

a second jaw portion coupled to a second shim;

a first fastener; and a second fastener;

wherein, upon actuation of the pliers, the first and second jaw portions close to bend respective electrode supports of a pair of opposing electrodes or to bend the pair of opposing electrodes to set a radial gap distance relative to a longitudinal length of a spark plug between the pair of opposing electrodes, and wherein the first and second jaw portions are configured to interchangeably couple to shims of different thicknesses to provide different radial gap distances between the pair of opposing electrodes upon actuation of the pliers, and wherein the first jaw portion has a first bore extending through the first jaw portion in a first direction crosswise to a first longitudinal length of the first jaw portion, the first fastener is disposed within the first bore and extends through the first shim to couple the first shim to the first jaw portion, the second jaw portion has a second bore extending through the second jaw portion in a second direction crosswise to a second longitudinal length of the second jaw portion, and the second fastener is disposed within the second bore and extends through the second shim to couple the second shim to the second jaw portion.

14. The pliers of claim 13, wherein the first and second fasteners are configured to have a respective position adjusted within the first and second bores to enable removal of the first and second shims from the pliers.

15. Spark plug electrode gap setting pliers, comprising:

a first jaw portion coupled to a first shim; and a second jaw portion coupled to a second shim;

wherein, upon actuation of the pliers, the first and second jaw portions close in parallel to bend respective electrode supports of a pair of electrodes or to bend the pair of electrodes to provide a parallel gap between the pair of electrodes, and wherein the first jaw portion comprises a first recess, a first portion of the first shim is disposed within the first recess, the second jaw portion comprises a second recess, and a second portion of the second shim is disposed within the second recess.

16. A system, comprising:

a tool configured to set a spark plug electrode gap between a pair of electrodes of a spark plug, wherein the tool comprises:

a first jaw portion comprising a first portion and a second portion, wherein the first portion has a first longitudinal length and the second portion has a second longitudinal length less than the first longitudinal length;

a second jaw portion comprising a third portion and a fourth portion disposed across from the first and second portions of the first jaw portion respectively, wherein the third portion has a third longitudinal length and the fourth portion has a fourth longitudinal length less than the third longitudinal length;

a first handle portion coupled to the first portion of the first jaw portion; and a second handle portion coupled to the third portion of the second jaw portion, wherein the first and second handle portions are coupled at a fulcrum, and the first and second jaw portions are configured to close in parallel with respect to each other along the first, second, third, and fourth longitudinal lengths upon actuation of the first and second handle portions;

a first shim contacting the first jaw portion; and a second shim contacting the second jaw portion;

wherein the second longitudinal length of the second portion of the first jaw portion and the fourth longitudinal length of the fourth portion of the second jaw portion, upon actuation of the first and second handle portions, provide a bending moment to the first and second shims, respectively, to bend respective electrode supports of the pair of electrodes or to bend the pair of electrodes to provide a parallel gap between the pair of electrodes, and wherein the first portion of the second jaw portion and the third portion of the second jaw portion are each configured to interchangeably couple to shims of different thicknesses to provide different parallel gap distances between the pair of electrodes upon actuation of the first and second handle portions.

17. A system, comprising:

a tool configured to set a spark plug electrode gap between a pair of electrodes of a spark plug, wherein the tool comprises:

a first jaw portion comprising a first portion and a second portion, wherein the first portion has a first longitudinal length and the second portion has a second longitudinal length less than the first longitudinal length;

a second jaw portion comprising a third portion and a fourth portion disposed across from the first and second portions of the first jaw portion respectively, wherein the third portion has a third longitudinal length and the fourth portion has a fourth longitudinal length less than the third longitudinal length;

a first handle portion coupled to the first portion of the first jaw portion; and a second handle portion coupled to the third portion of the second jaw portion, wherein the first and second handle portions are coupled at a fulcrum, and the first and second jaw portions are configured to close in parallel with respect to each other along the first, second, third, and fourth longitudinal lengths upon actuation of the first and second handle portions;

a first shim contacting the first jaw portion; and a second shim contacting the second jaw portion;

wherein the second longitudinal length of the second portion of the first jaw portion and the fourth longitudinal length of the fourth portion of the second jaw portion, upon actuation of the first and second handle portions, provide a bending moment to the first and second shims, respectively, to bend respective electrode supports of the pair of electrodes or to bend the pair of electrodes to provide a parallel gap between the pair of electrodes, and wherein the first jaw portion and the first handle portion are separate pieces, and the second jaw portion and the second handle portion are separate pieces.

* * * * *